US010939731B2

(12) United States Patent
Hsu et al.

(10) Patent No.: US 10,939,731 B2
(45) Date of Patent: Mar. 9, 2021

(54) METHOD FOR SECURING A SHOELACE ONTO A SHOE UPPER AND AN AUTOMATIC SHOE-LACING SYSTEM

(71) Applicant: POU CHEN CORPORATION, Chang Hwa Hsien (TW)

(72) Inventors: Chien-Yu Hsu, Fu Hsin Hsian (TW); Wen-Pao Chang, Fu Hsin Hsian (TW); Yao-Hsin Wang, Fu Hsin Hsian (TW); Wei-Hsin Hsu, Fu Hsin Hsian (TW)

(73) Assignee: Pou Chen Corporation

( * ) Notice: Subject to any disclaimer, the term of this patent is extended or adjusted under 35 U.S.C. 154(b) by 77 days.

(21) Appl. No.: 16/378,863

(22) Filed: Apr. 9, 2019

(65) Prior Publication Data

US 2020/0221828 A1 Jul. 16, 2020

(30) Foreign Application Priority Data

Jan. 14, 2019 (TW) ..... 108101406

(51) Int. Cl.
*A43D 11/08* (2006.01)
*A43C 7/00* (2006.01)
*A43C 1/00* (2006.01)

(52) U.S. Cl.
CPC ..... *A43D 11/085* (2013.01); *A43C 7/00* (2013.01); *A43C 1/00* (2013.01); *A43D 2200/10* (2013.01)

(58) Field of Classification Search
CPC ..... A43B 11/08; A43B 11/085; A43D 11/08; A43D 11/085
USPC ..... 12/58.5
See application file for complete search history.

(56) References Cited

U.S. PATENT DOCUMENTS 2,311,165 A * 2/1943 Fossa ..... A43D 11/085 12/58.5
2,327,345 A * 8/1943 Fossa ..... A43D 11/085 12/58.5
2,383,538 A * 8/1945 Fossa ..... A43D 11/085 12/58.5
2,404,834 A * 7/1946 Fossa ..... A43D 11/085 12/58.5
2,883,687 A * 4/1959 Fossa ..... A43D 11/085 12/58.5
10,555,583 B2 * 2/2020 Yang ..... G06T 7/70
2018/0255880 A1 9/2018 Yang et al.

FOREIGN PATENT DOCUMENTS

CN 103876393 A 6/2014

* cited by examiner

*Primary Examiner* — Marie D Bays
(74) *Attorney, Agent, or Firm* — Lewis Roca Rothgerber Christie LLP

(57) ABSTRACT

An automatic shoe-lacing system includes a support unit for supporting a shoe upper thereon, a robotic arm unit disposed to hold an end portion of a shoelace to move along an eyelet passing path through predetermined shoelace eyelets of the shoe upper, and at least one hook unit. The hook unit has a hook disposed to hold and tense a flexible lace body of the shoelace to prevent twist of the shoelace during the shoe-lacing operation.

11 Claims, 15 Drawing Sheets

METHOD FOR SECURING A SHOELACE ONTO A SHOE UPPER AND AN AUTOMATIC SHOE-LACING SYSTEM

CROSS-REFERENCE TO RELATED APPLICATION

This application claims priority of Taiwanese Patent Application No. 108101406, filed on Jan. 14, 2019.

FIELD

The disclosure relates to an automatic shoe-lacing system, and more particularly to a method for securing a shoelace onto a shoe upper and an automatic and anti-twisting shoe-lacing system.

BACKGROUND

A conventional automatic shoe-lacing machine, such as those disclosed in CN 103876393 and U.S. Publication No. 2018/0255880, has been developed to perform a shoe-lacing process. During the shoe-lacing process, a flexible, long and flat shoelace is liable to be casually twisted so as to be unevenly and unsmoothly disposed onto the shoe upper, which is uncomfortable for the wearer, and adversely affects the outer appearance of the shoe.

SUMMARY

Therefore, an object of the disclosure is to provide a method for securing a shoelace onto a shoe upper and an automatic shoe-lacing system that can alleviate at least one of the drawbacks of the prior art.

According to an aspect of the disclosure, the method for securing a shoelace onto a shoe upper includes steps of: a) providing the shoe upper and the shoelace, wherein the shoe upper has a plurality of shoelace eyelets, and the shoelace has two opposite end portions and a flexible lace body interconnecting the end portions; b) holding at least one of the end portions of the shoelace, by a robotic arm unit, and moving the at least one end portion along an eyelet passing path, wherein, along the eyelet passing path, the flexible lace body is held by at least one hook, and is extended through predetermined ones of the shoelace eyelets; c) during the movement of the at least one end portion along the eyelet passing path, moving the at least one hook relative to the shoe upper between an initial position, where the at least one hook is remote from the shoe upper, and a finished position, where the at least one hook is close to the shoe upper, wherein, during the movement of the at least one hook from the initial position to the finished position, the flexible lace body is tensed by the at least one hook, and in the finished position, the flexible lace body is removed from the at least one hook; and repeating steps b) and c) until each of the end portions of the shoelace passes through a predetermined number of the shoelace eyelets so as to secure the shoelace onto the shoe upper.

According to another aspect of the disclosure, the automatic shoe-lacing system includes a support unit on which a shoe upper is supported, a robotic arm unit, and at least one hook unit. The robotic arm unit is disposed to hold at least one end portion of the shoelace and to move the at least one end portion along an eyelet passing path, wherein, along the eyelet passing path, the at least one end portion passes through a predetermined number of shoelace eyelets of the shoe upper, and the flexible lace body is extended through and secured on the shoe upper. The at least one hook unit includes a hook and a hook driving assembly which is disposed to drive a movement of the hook in a first direction such that, during the movement of the at least one end portion along the eyelet passing path, the hook is disposed to hold the flexible lace body, and is moved relative to the shoe upper between an initial position, where the hook is remote from the shoe upper, and a finished position, where the hook is close to the shoe upper, and such that, during the movement of the hook from the initial position to the finished position, the hook is disposed to tense the flexible lace body, and in the finished position, the hook is disengaged from the shoelace.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
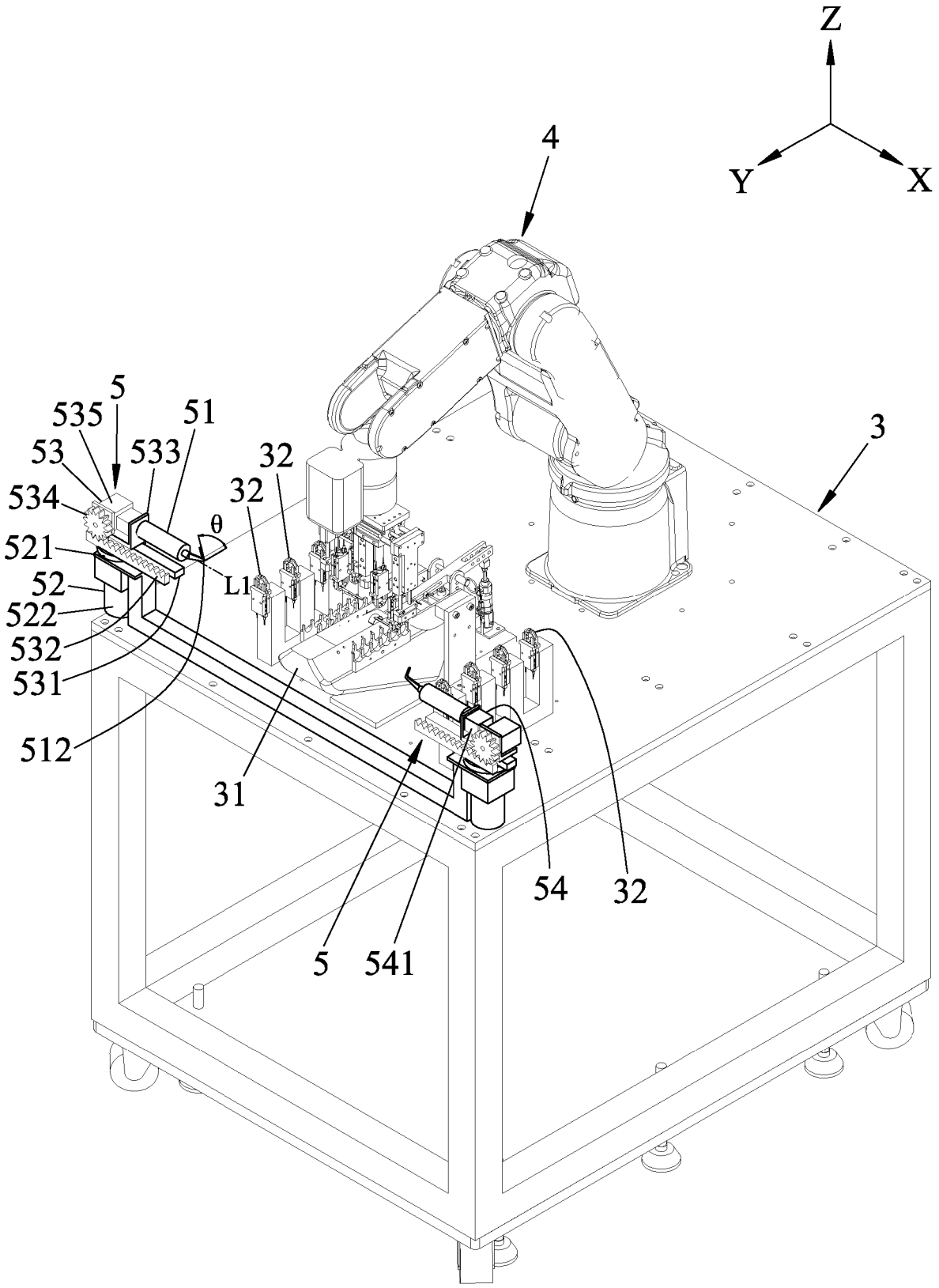
FIG. 1 is a perspective view illustrating an embodiment of an automatic shoe-lacing system according to the disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

Referring to FIGS. 1 to 4, an embodiment of an automatic shoe-lacing system is for securing a shoelace 1 onto a shoe upper 2. The shoelace 1 has two opposite end portions 11 and a flexible lace body 12 interconnecting the end portions 11. The flexible lace body 12 has two opposite lace major surfaces 121. The shoe upper 2 has a plurality of shoelace eyelets 21. The shoe-lacing system includes a support unit 3, a robotic arm unit 4, two hook units 5 arranged opposite to each other in a first direction (X), and a control unit 6.

The support unit 3 includes an upper holding device 31 for holding the shoe upper 2 thereon, and a plurality of shoelace holding assemblies 32 arranged as two arrays extending in a second direction (Y) transverse to the first direction (X) and disposed at two sides of the upper holding device 31. Each end portion 11 of the shoelace 1 is releasably positioned by a corresponding one of the shoelace holding assemblies 32.

In this embodiment, the robotic arm unit 4 is disposed to sequentially hold the end portions 11 of the shoelace 1 to release the end portions 11 from the corresponding shoelace holding assemblies 32, and in turn to move each end portion 11 along an eyelet passing path until the end portion 11 is positioned by another shoelace holding assembly 32. Along the eyelet passing path, the end portion 11 passes through a predetermined number of the shoelace eyelets 21, and the flexible lace body 12 is extended through and secured on the shoe upper 2. Since the technique of the robotic arm unit 4 holding and moving the end portions 11 of the shoelace 1 through the predetermined shoelace eyelets 21 is of a known type, such as those disclosed in U.S. Publication No. 2018/0255880, TWI611888, TWI629015, etc., a description thereof is dispensed with herein for the sake of brevity. Moreover, two robotic arm units 4 may be disposed for holding two end portions 11 of the shoelace 1, respectively, for reducing the time of shoe-lacing process.

The hook units 5 are mounted on the support unit 3 and are spaced apart from each other in the first direction (X) to be disposed at two sides of the shoe upper 2, respectively. Each hook unit 5 includes a hook 51, an unhook driving assembly 52, a hook driving assembly 53 and a revolving driving assembly 54.

Figure 2:
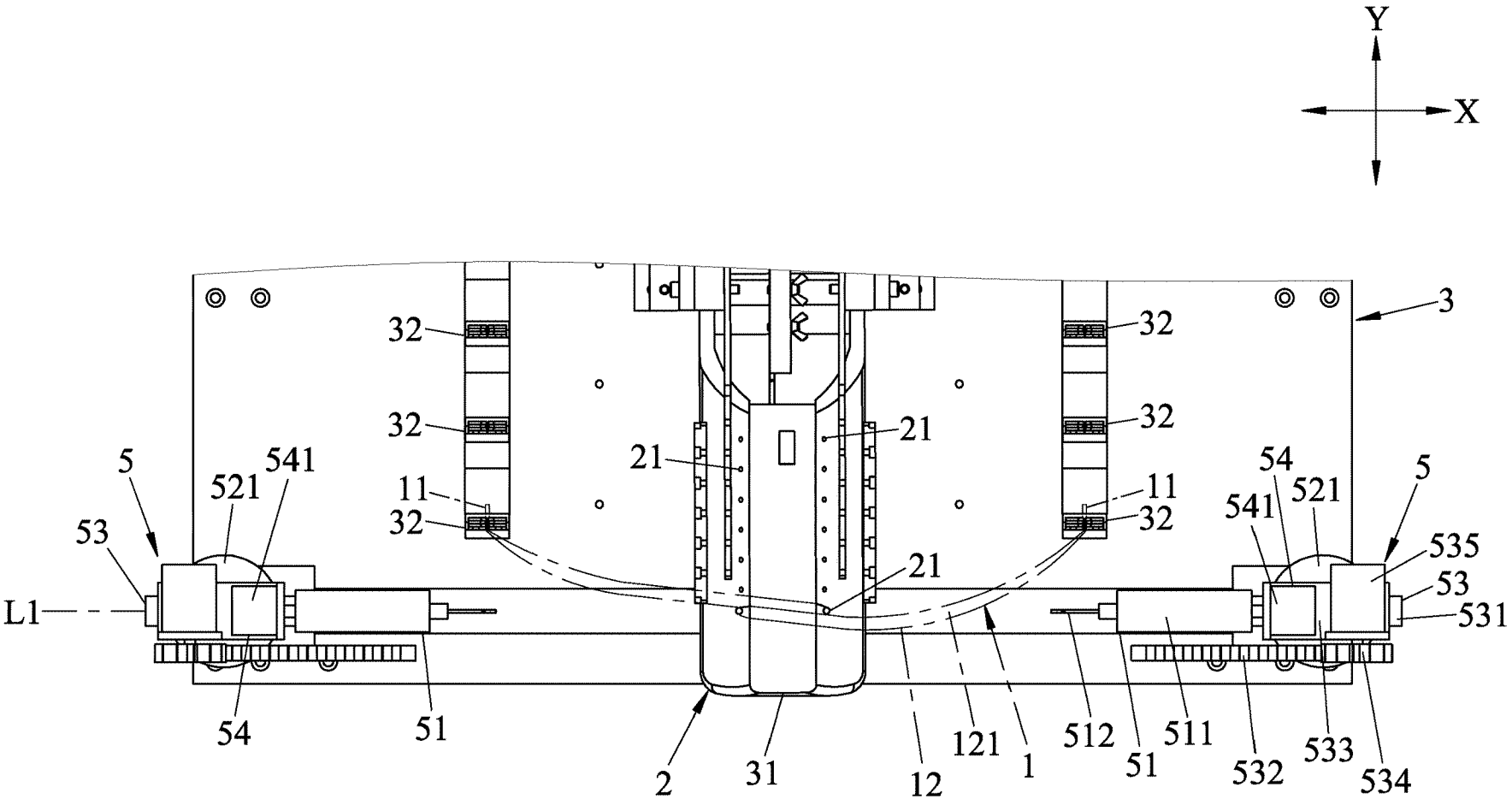
FIG. 2 is a fragmentary top view of the embodiment.
Figure 5:
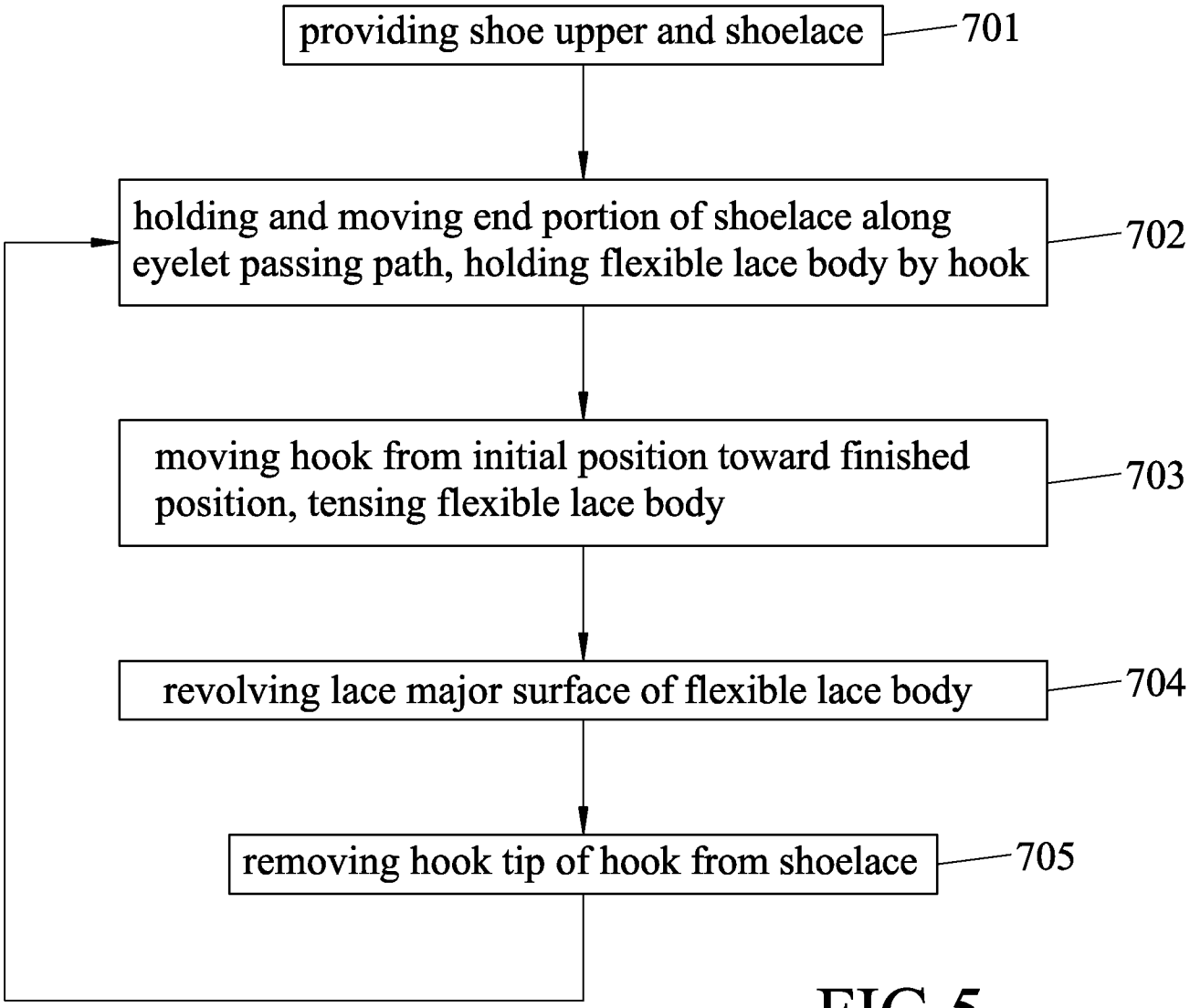
FIG. 5 is a process diagram of the process steps of the embodiment.
Figure 6:
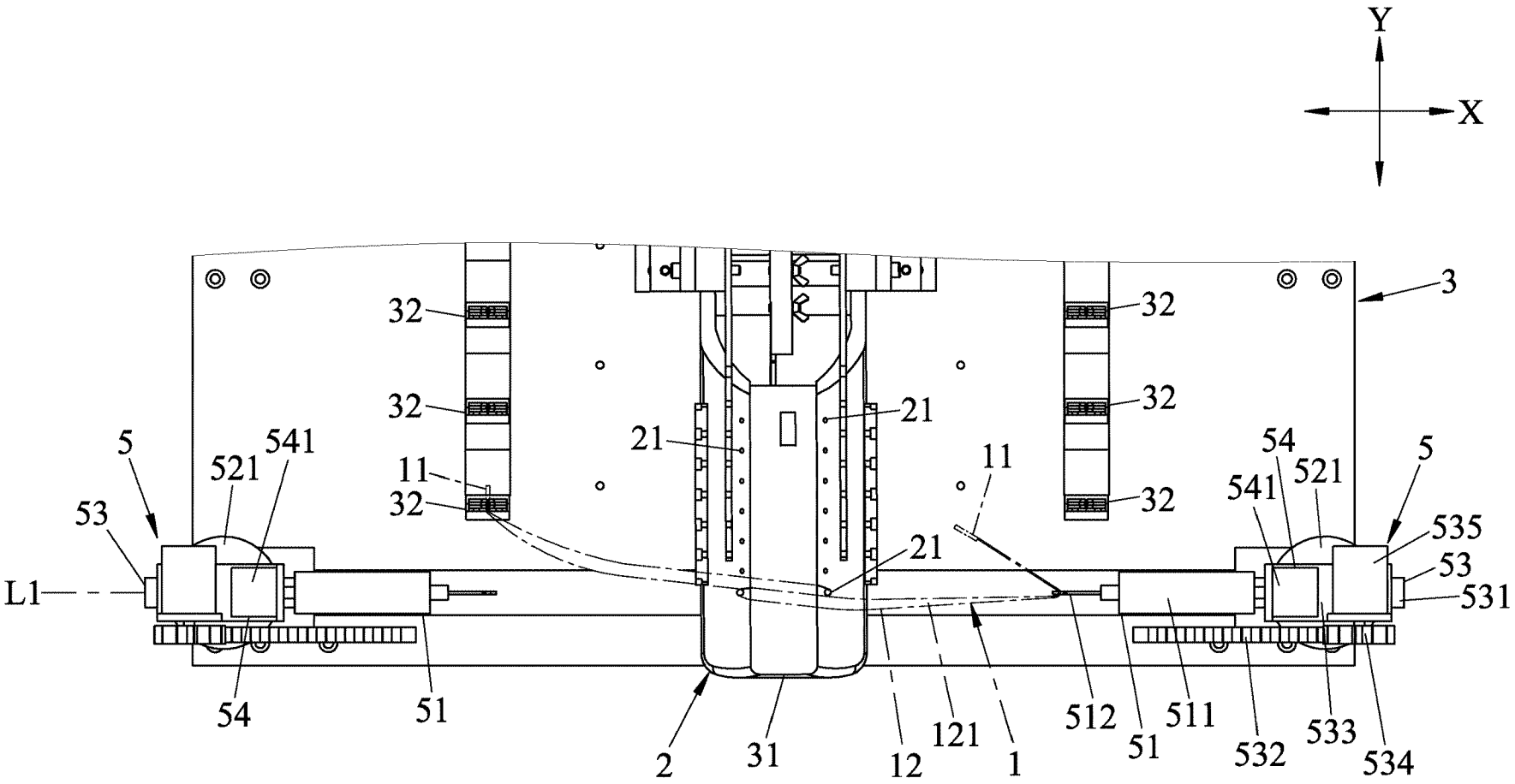
FIGS. 6 to 11 are fragmentary top views similar to FIG. 2, wherein a hook unit of the embodiment during various phases of a shoe-lacing cycle is illustrated.
Figure 7:
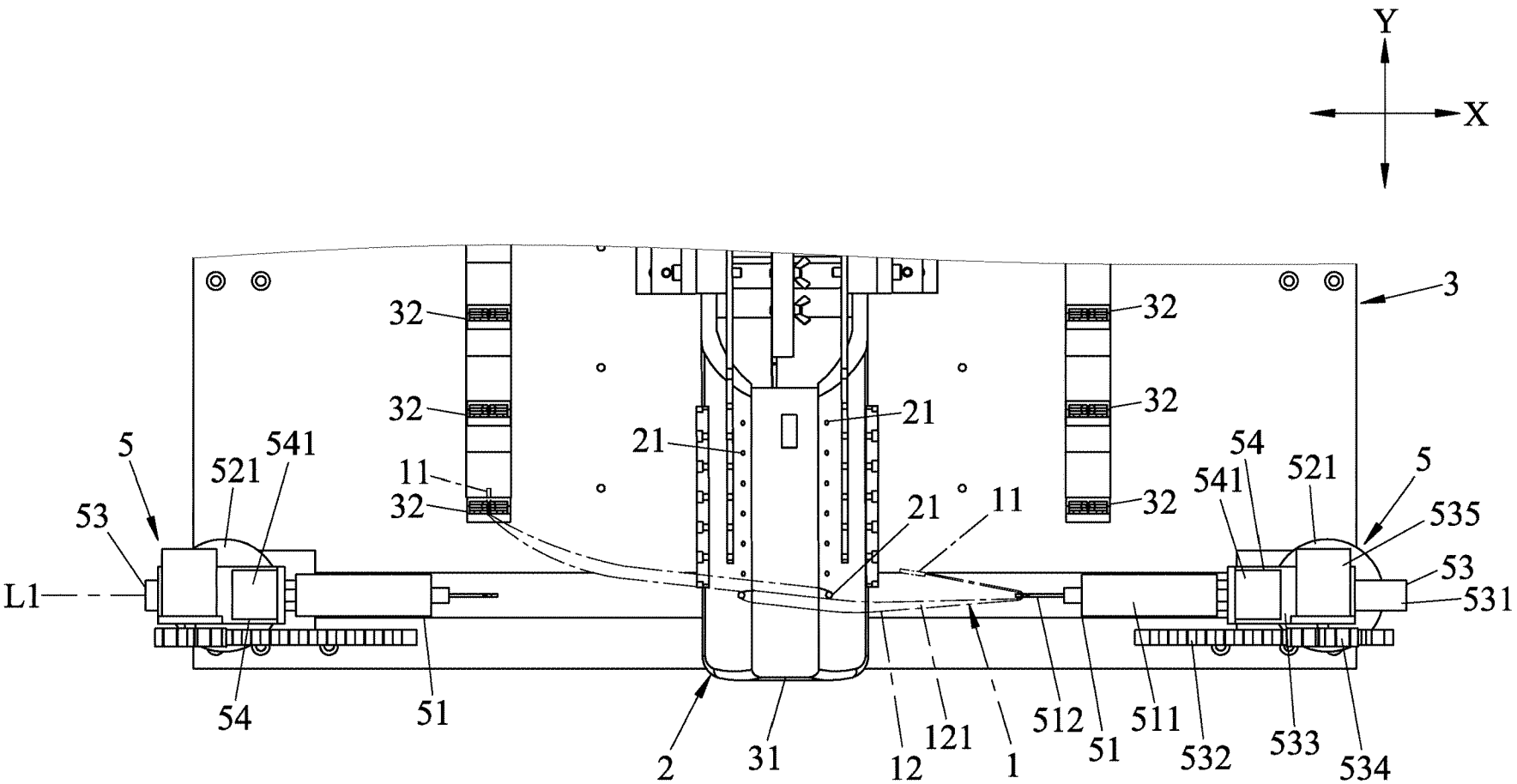
Figure 8:
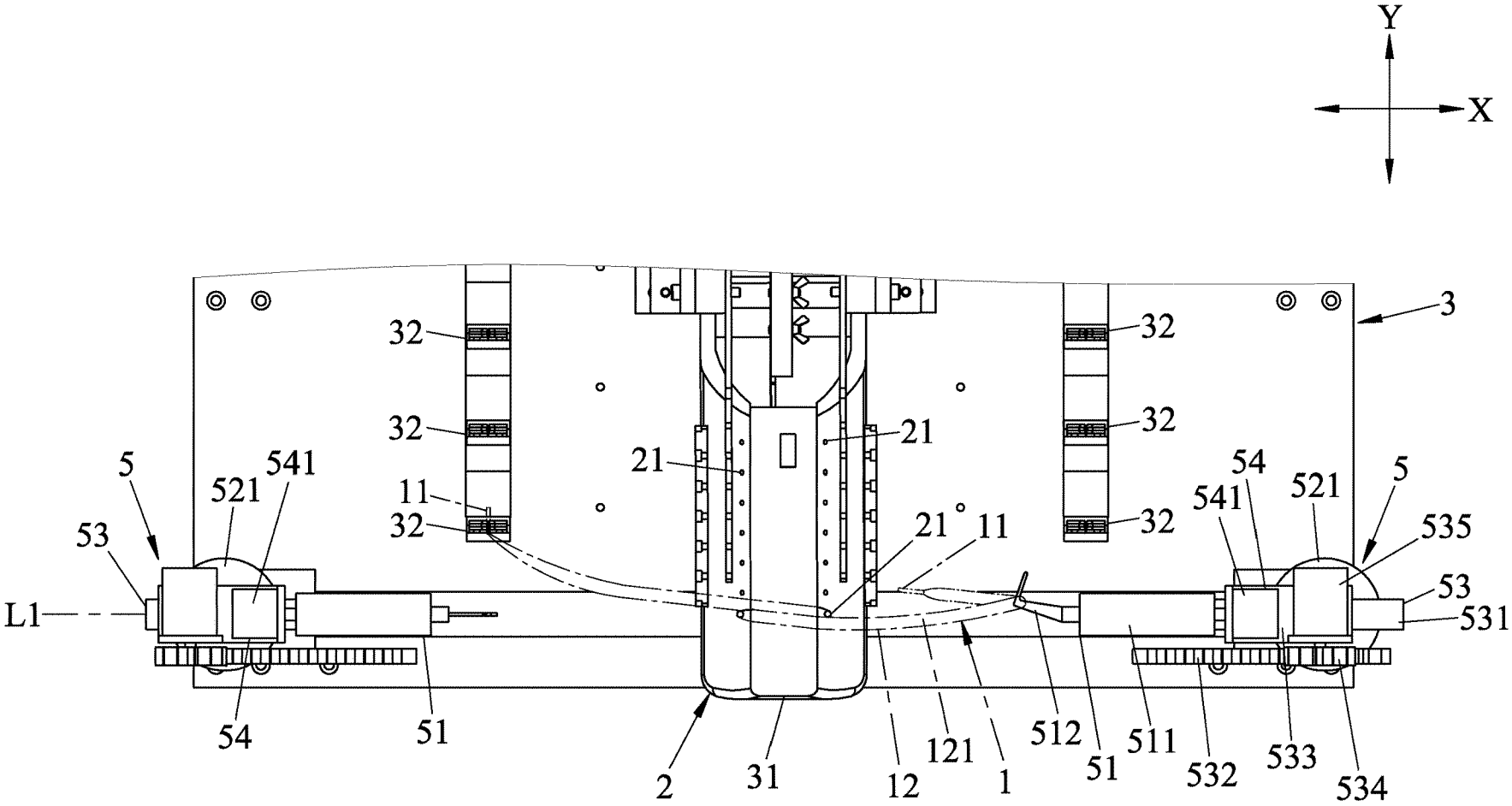

The hook 51 has a shaft 511 which extends along a shaft axis (L1) parallel to the first direction (X) to terminate at a shaft end, and a hook tip 512 which is disposed on the shaft end to hook and tense the flexible lace body 12 of the shoelace 1. The hook 51 is movable along the shaft axis (L1) relative to the shoe upper 2 between an initial position (as shown in FIGS. 2 and 5), where the hook tip 512 is remote from the shoe upper 2, and a finished position (as shown in FIG. 8), where the hook tip 512 is close to the shoe upper 2.

The unhook driving assembly 52 has a rotary worktable 521 which is rotatable about a table axis (L2) that is transverse to the shaft axis (L1), and an unhook motor 522 which is disposed to drive the rotation of the rotary worktable 521. The table axis (L2) is parallel to a third direction (Z) that is transverse to both the first direction (X) and the second direction (Y).

The hook driving assembly 53 is supported on the rotary worktable 521, and has a slide rail 531 and a rack 532 both of which extend in the first direction (X) and are parallel to each other, a carrier 533 which is slidably disposed on the slide rail 531 and on which the hook 51 is mounted, a first motor 535 which is mounted on the carrier 533, and a pinion 534 which meshes with the rack 532 and is driven by the first motor 535 such that rotation of the pinion 534 results in the movement of the carrier 533 along the slide rail 531.

The revolving driving assembly 54 is supported on the rotary worktable 521, and has a revolving motor 541 which is mounted on the carrier 533 and is connected with the shaft 511 of the hook 51 for driving the shaft 511 to revolve about the shaft axis (L1) by a predetermined angle (θ). In this embodiment, the angle (θ) ranges from 85 to 95 degrees.

In an alternative embodiment, the shoe-lacing system may include one hook unit 5 which may be displaced anywhere along a U-shaped path around the shoe upper 2 to correspond to position in which the end portions 11 of the shoelace 1 are to be gripped.

Figure 3:
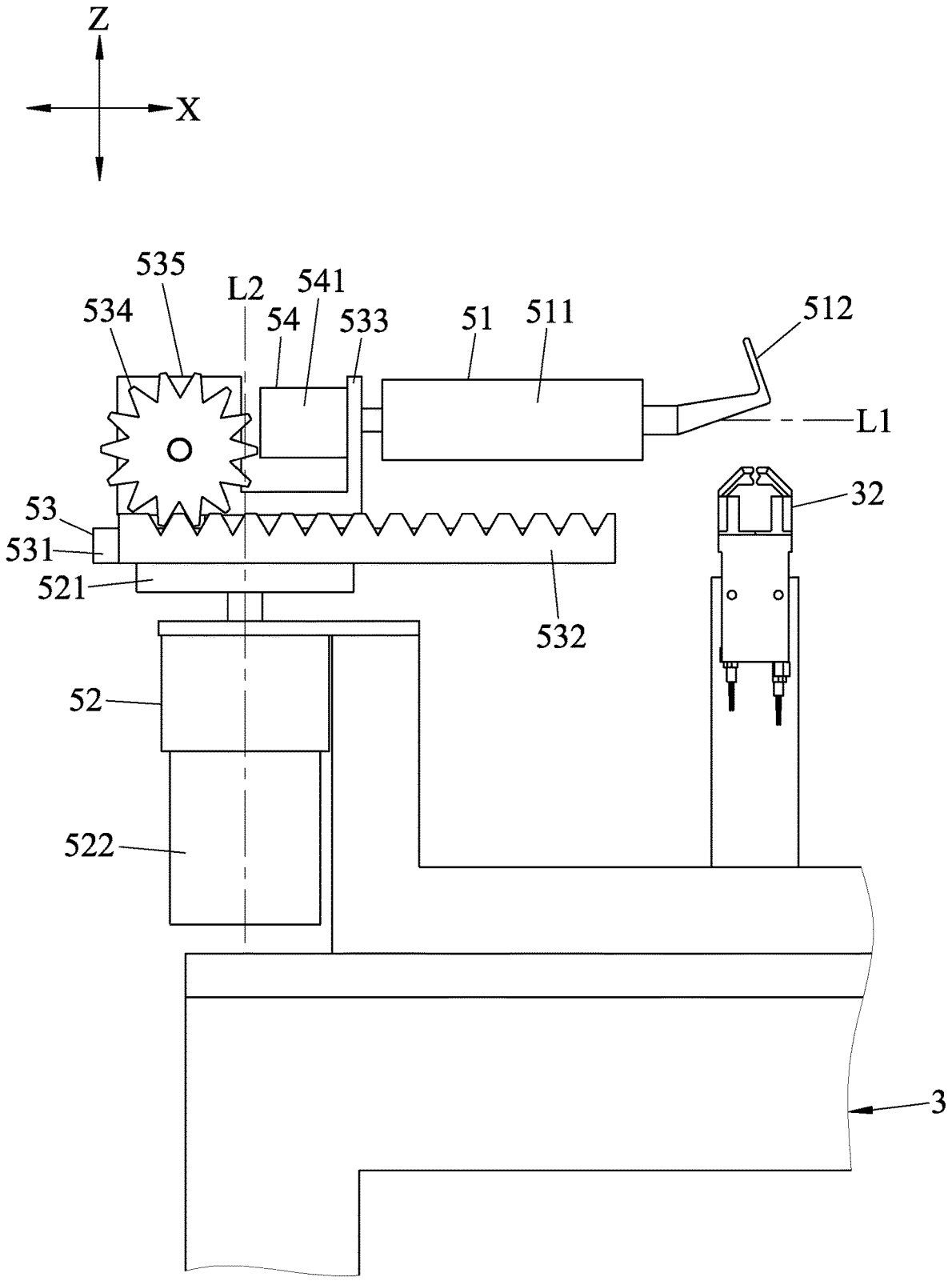
FIG. 3 is a fragmentary front view of the embodiment.
Figure 4:
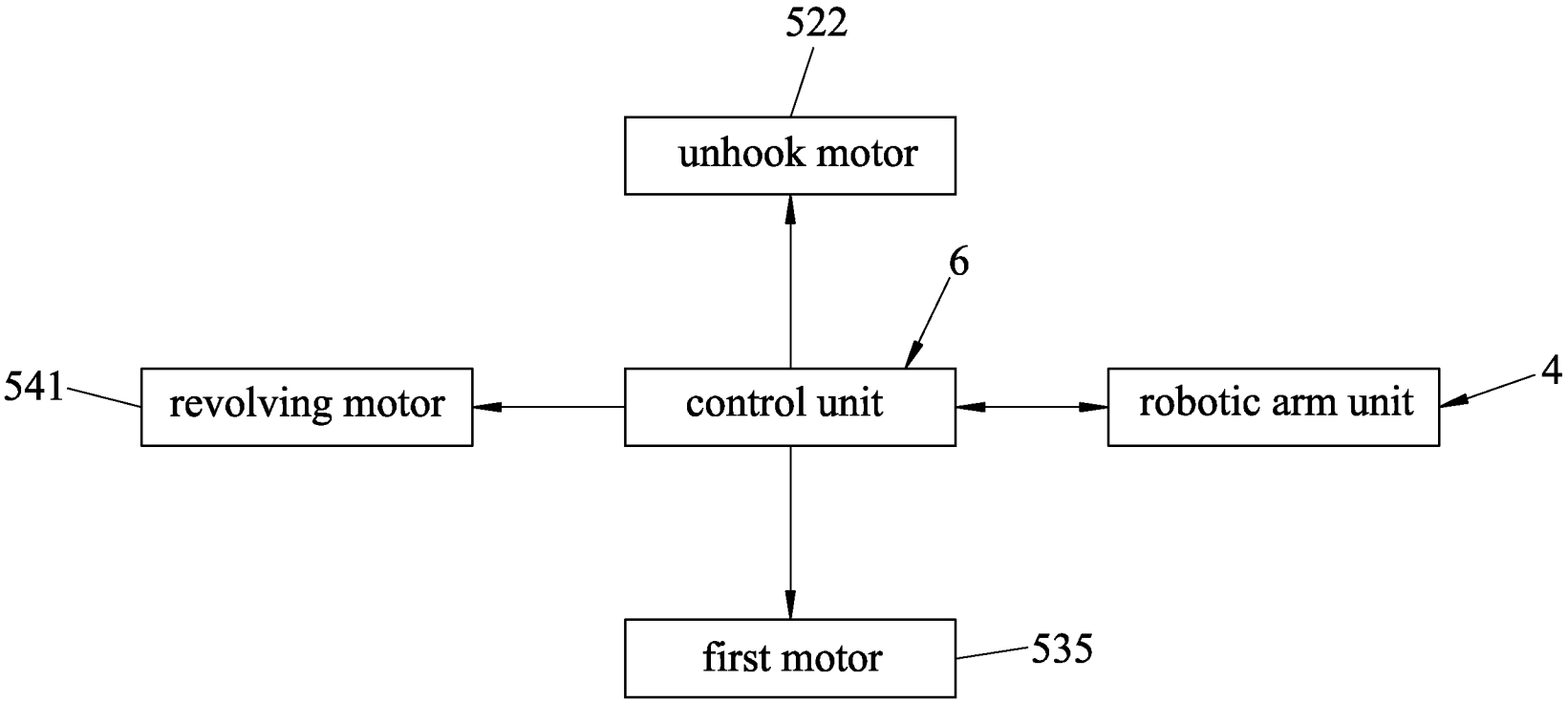
FIG. 4 is a block diagram of the elements of the embodiment.

Referring to FIGS. 3 and 4, the control unit 6 is electronically connected with the robotic arm unit 4 and the unhook motor 522, the first motor 535, and the revolving motor 541 of the hook units 5, and is operable for a user to program the eyelet passing path for the robotic arm unit 4 and to control the operations of the unhook motor 522, the first motor 535 and the revolving motor 541.

Figure 9:
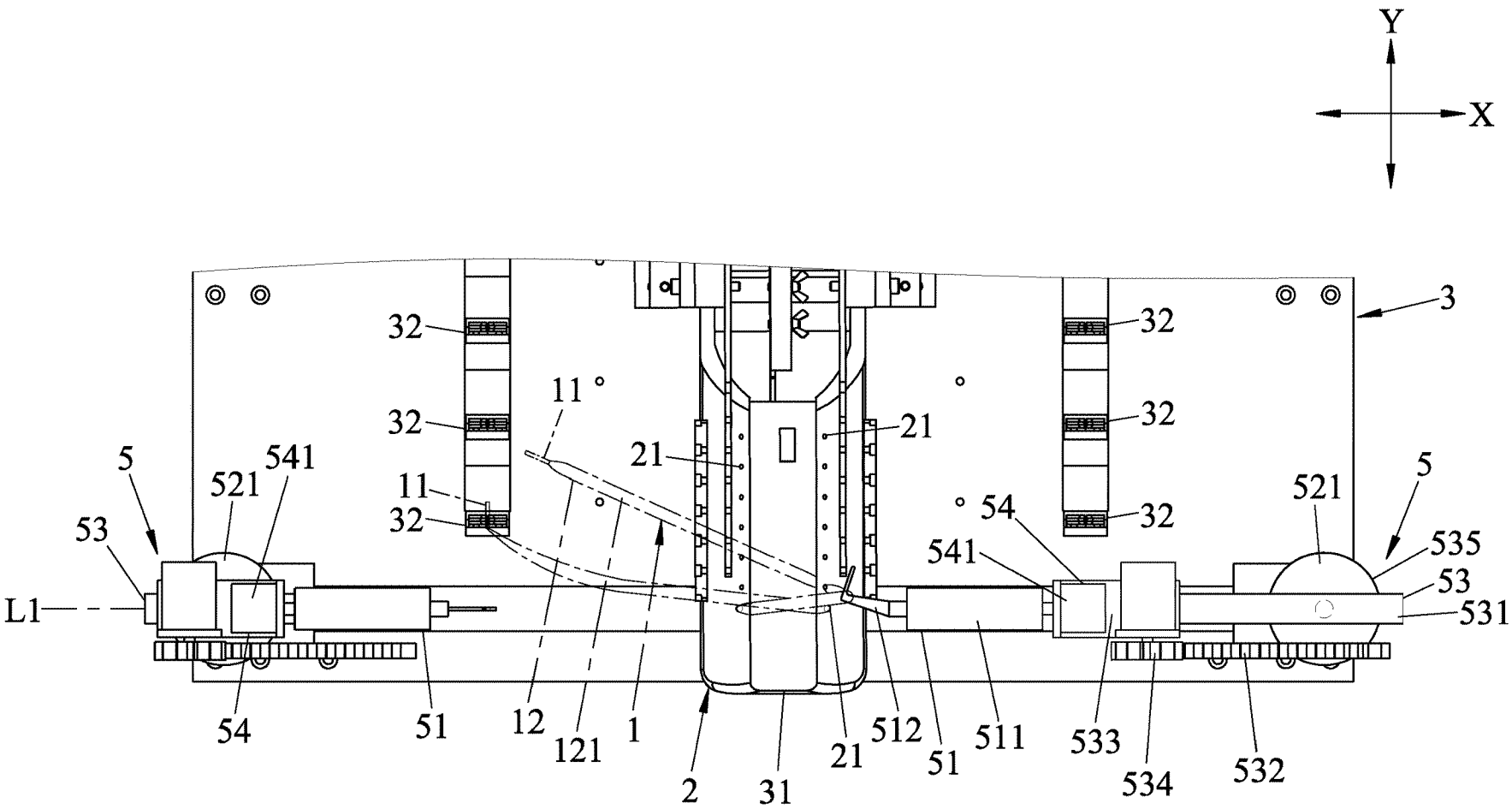
Figure 10:
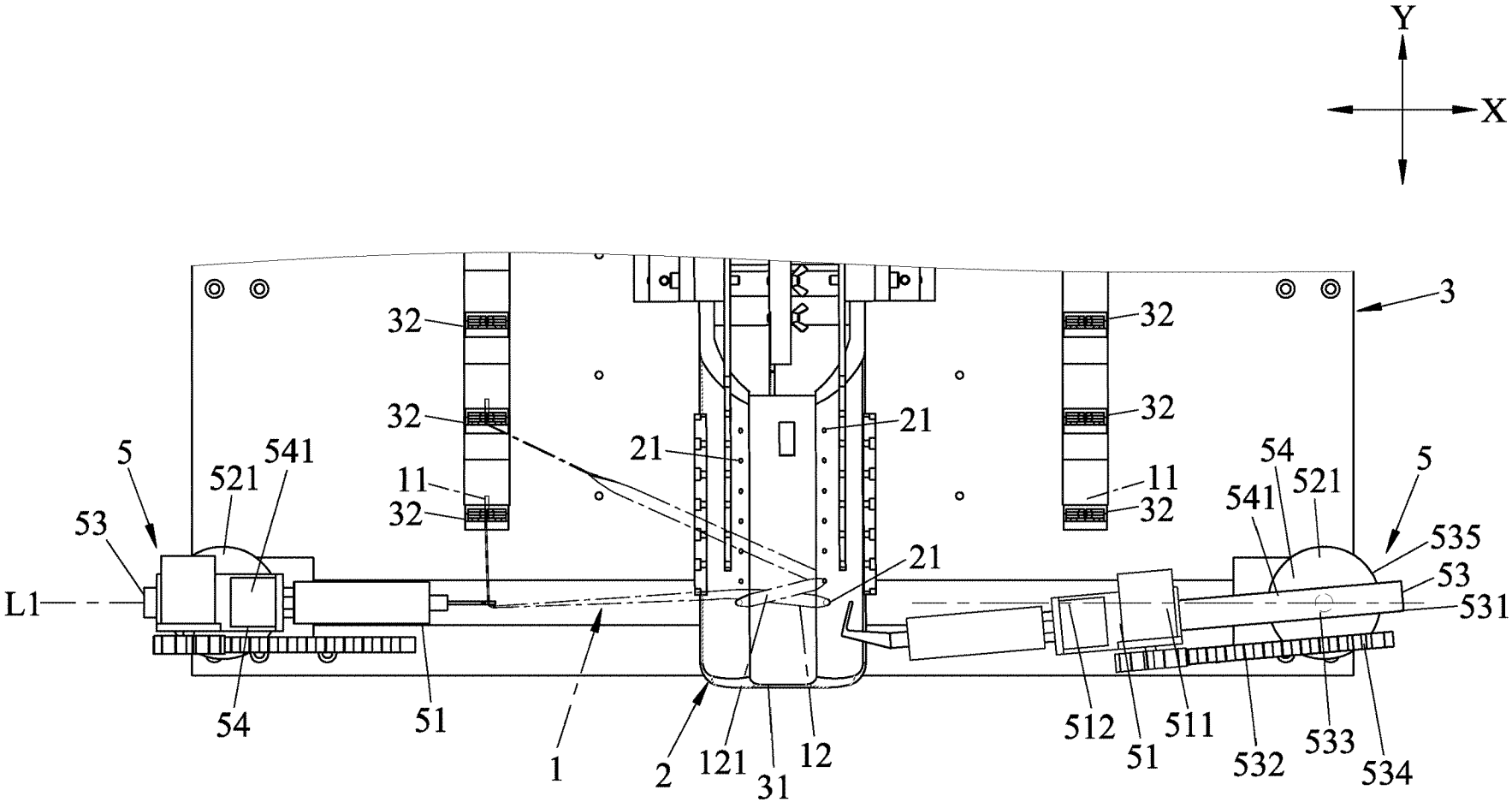
Figure 11:
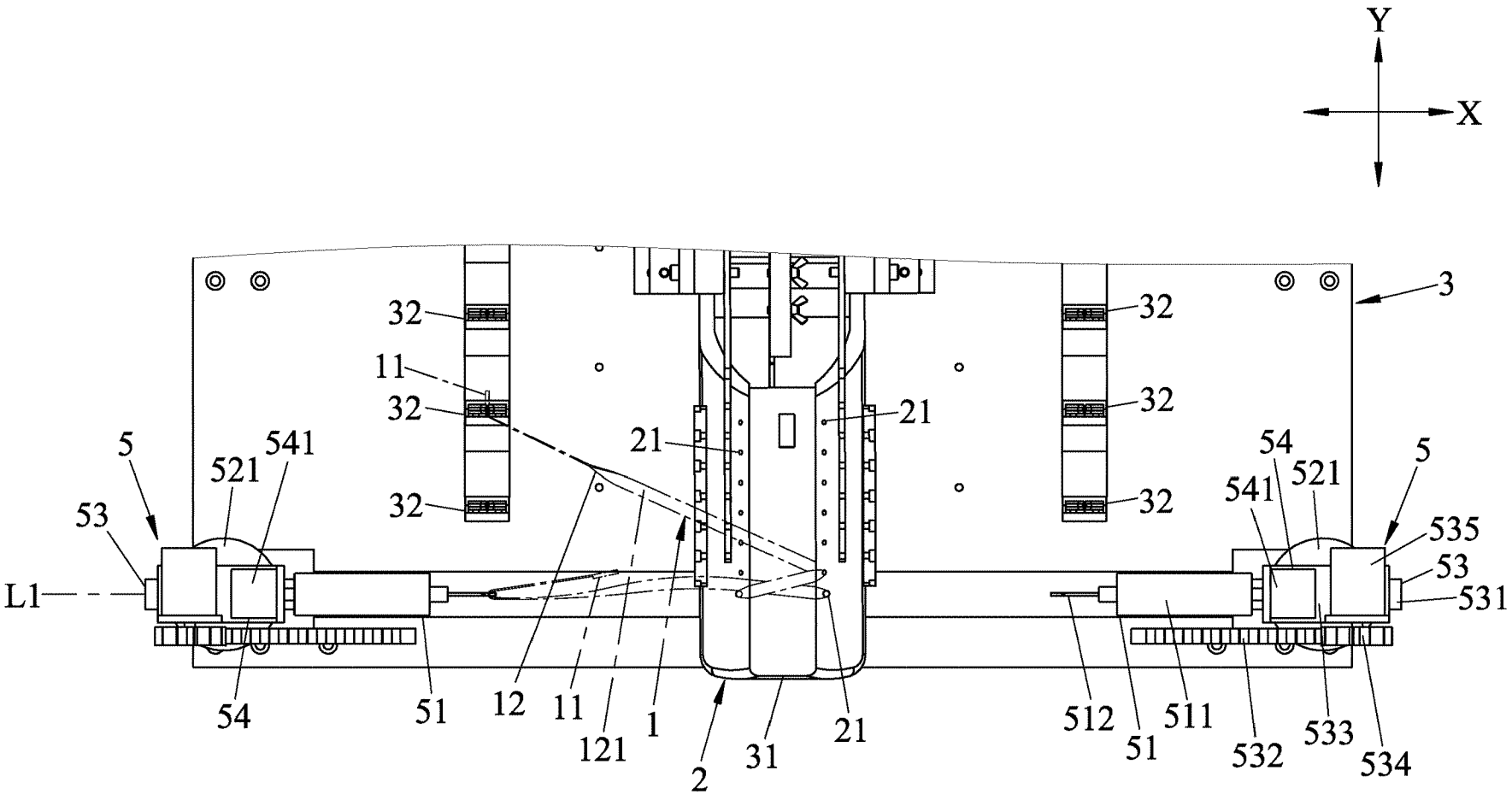

Referring to FIGS. 2, 4 and 5, the method for securing a shoelace 1 onto a shoe upper 2 includes the following steps:

step 701: providing the shoe upper 2 and the shoelace 1 on the support unit 3;

step 702: referring to FIGS. 1, 3, 6 and 7, holding one of the end portions 11 of the shoelace 1, by the robotic arm unit 4 controlled by the control unit 6, and moving the end portion 11 along the programmed eyelet passing path, wherein, along the eyelet passing path, the flexible lace body 12 is held by the hook tip 512 of the hook 51 in the initial position. At this stage, the hook tip 512 is moved along the shaft axis (L1) and abuts against one of the lace major surfaces 121 of the flexible lace body 12 such that the lace major surface 121 is extended along the shaft axis (L1);

step 703: during the movement of the end portion 11 of the shoelace 1 along the eyelet passing path, controlling the first motor 535 by the control unit 6 to drive the rotation of the pinion 534 so as to move the carrier 533 and the hook 51 along the slide rail 531 from the initial position to the finished position relative to the shoe upper 2, wherein, the end portion 11 of the shoelace 1 gripped by the robotic arm unit 4 is extended through predetermined ones of the shoelace eyelets 21, and hence, the flexible lace body 12 is tensed by the hook tip 512;

step 704: referring to FIGS. 1, 3 and 9, during the movement of the hook 51 from the initial position toward the finished position, controlling the revolving motor 541 by the control unit 6 to drive the rotation of the shaft 511 of the hook 51 to the predetermined angle (θ) so as to revolve the flexible lace body 12 about 90 degrees to bring one of the lace major surfaces 121 into facing the shoe upper 2;

step 705: referring to FIGS. 1, 3 and 10, when the hook 51 is in the finished position, controlling the unhook motor 522 by the control unit 6 to drive the rotation of the rotary worktable 521 such that the hook driving assembly 53 and the revolving driving assembly 54 supported on the rotary worktable 521 are moved from the shaft axis (L1) so as to remove the hook tip 521 from the shoelace 1; and referring to FIGS. 6 to 11, repeating steps 702 to 705 until each of the end portions 11 of the shoelace 1 passes through a predetermined number of the shoelace eyelets 21 so as to secure the shoelace 1 onto the shoe upper 2 and have one lace major surface 121 facing the shoe upper 2.

Figure 12:
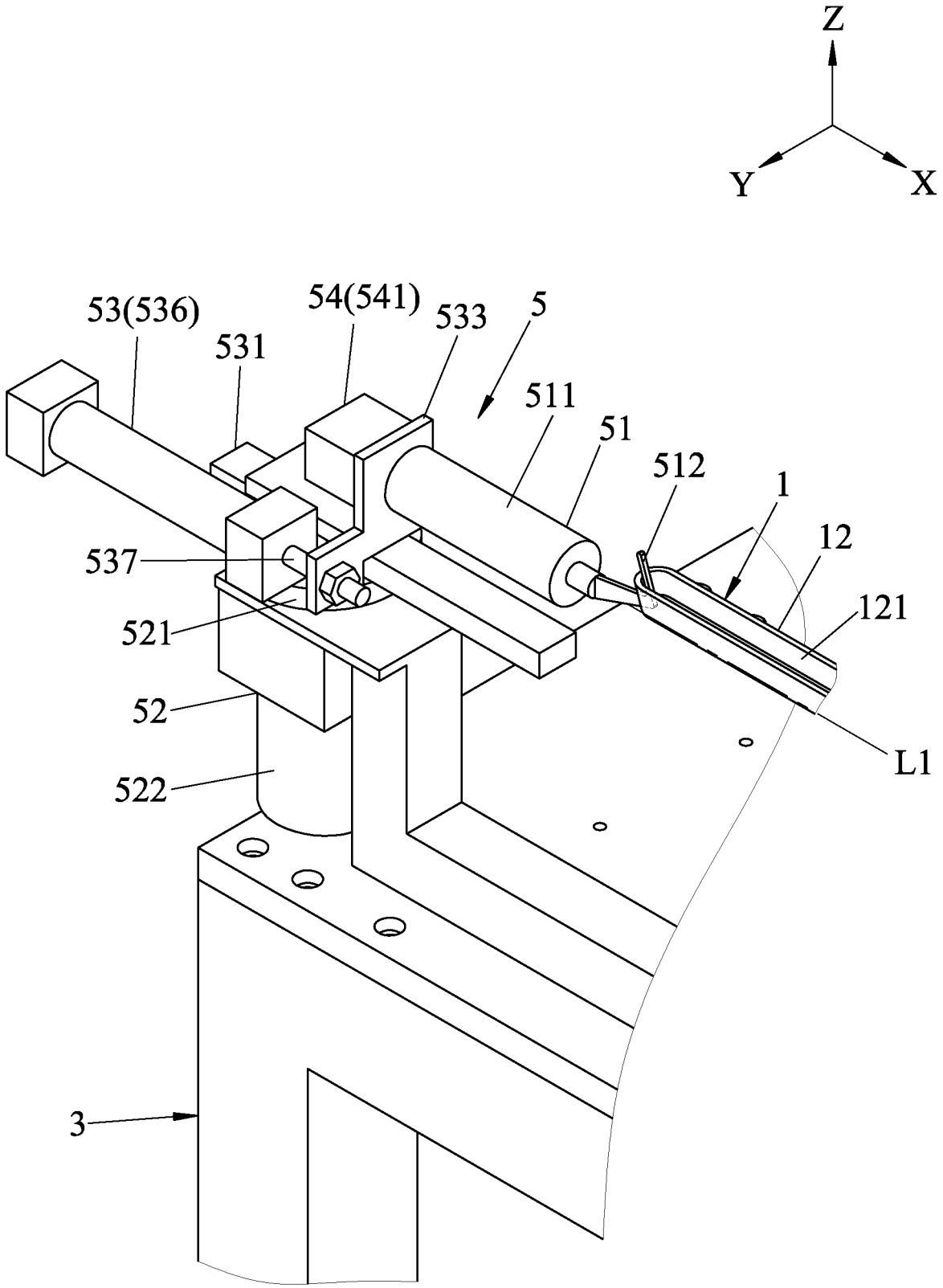
FIGS. 12 to 14 are fragmentary perspective views illustrating the hook unit of the embodiment indifferent modified forms.

In a modification of the embodiment, referring to FIG. 12, the hook driving assembly 53 has a piston-and-cylinder 536 which has a piston rod 537 that is connected with the carrier 533 to drive the movement of the carrier 533 along the slide rail 531.

Figure 13:
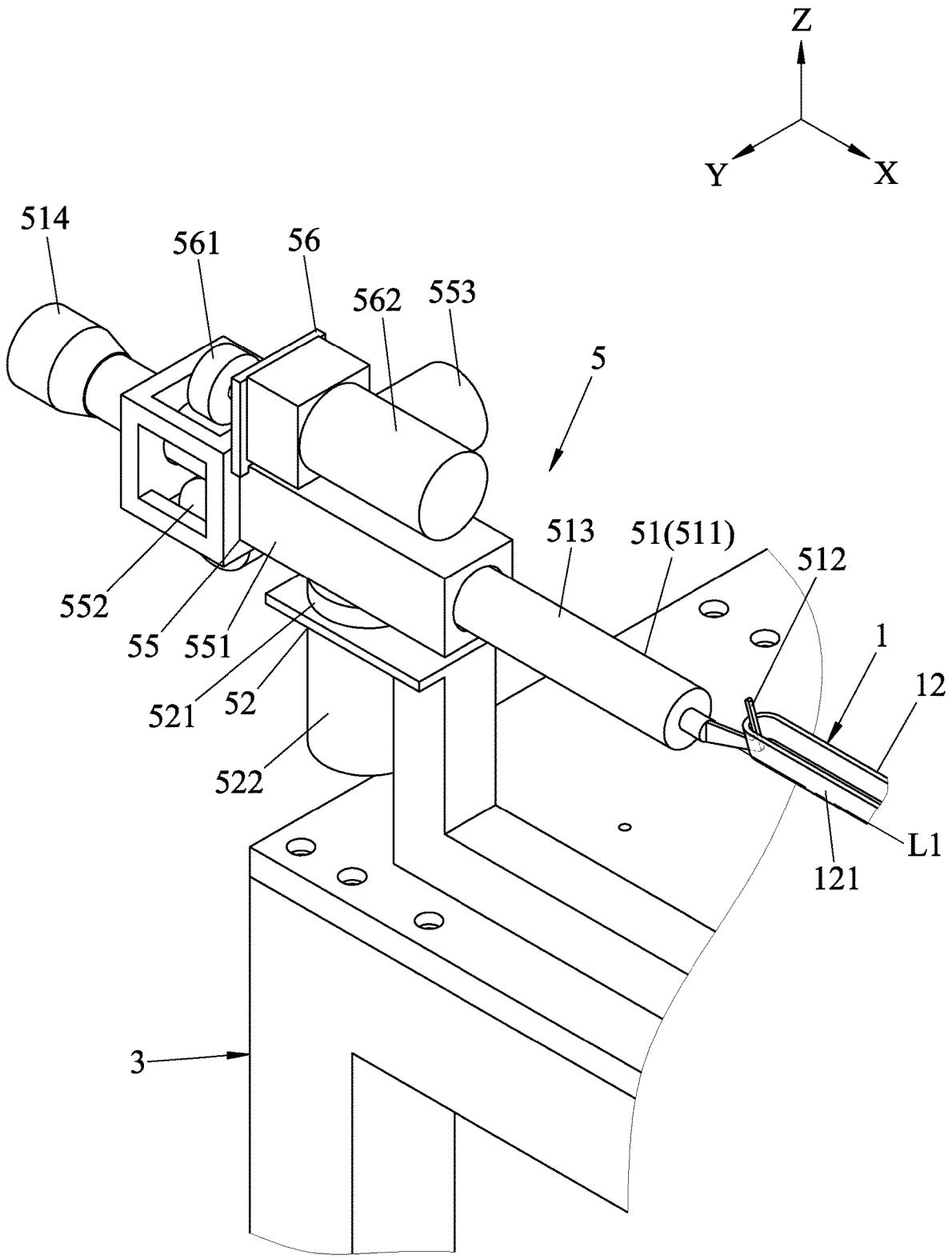

In another modification of the embodiment, referring to FIG. 13, each hook unit 5 includes a hook 51, an unhook driving assembly 52, a hook driving assembly 55 and a revolving driving assembly 56. The hook 51 has a shaft 511 which extends along a shaft axis (L1) parallel to the first direction (X) to terminate at proximate and distal shaft ends relative to the hook driving assembly 55, and a hook tip 512 which is disposed on the distal shaft end to hook and tense the flexible lace body 12 of the shoelace 1. The shaft 511 has a smaller-diameter segment 513 and a larger-diameter segment 514 which are disposed proximate to and distal from the hook tip 512, respectively. The hook driving assembly 55 has a tubular member 551 in which the proximate shaft end of the shaft 511 is movably received, a first friction wheel 552, and a second motor 553. The first friction wheel 552 is rotatable relative to the tubular member 551 about a first wheel axis in the second direction (Y) and in frictional engagement with the smaller-diameter segment 513 of the shaft 511 such that rotation of the first friction wheel 552 makes the movement of the shaft 511 along the shaft axis (L1). The second motor 553 is inclined to drive the rotation of the first friction wheel 552. The revolving driving assembly 56 is mounted on the tubular member 551, and has a second friction wheel 561 and a revolving motor 562. The second friction wheel 561 is rotatable relative to the tubular member 551 about a second wheel axis in the first direction (X) and is in frictional engagement with the larger-diameter segment 514 of the shaft 511 (i.e., the second friction wheel 561 is spaced apart from the smaller-diameter segment 513 of the shaft 511), such that rotation of the second friction wheel 561 causes revolving of the shaft 511 about the shaft axis (L1) by a predetermined angle. The a revolving motor 562 is disposed on the tubular member 551 to drive the rotation of the second friction wheel 561 by a friction action therebetween.

Figure 14:
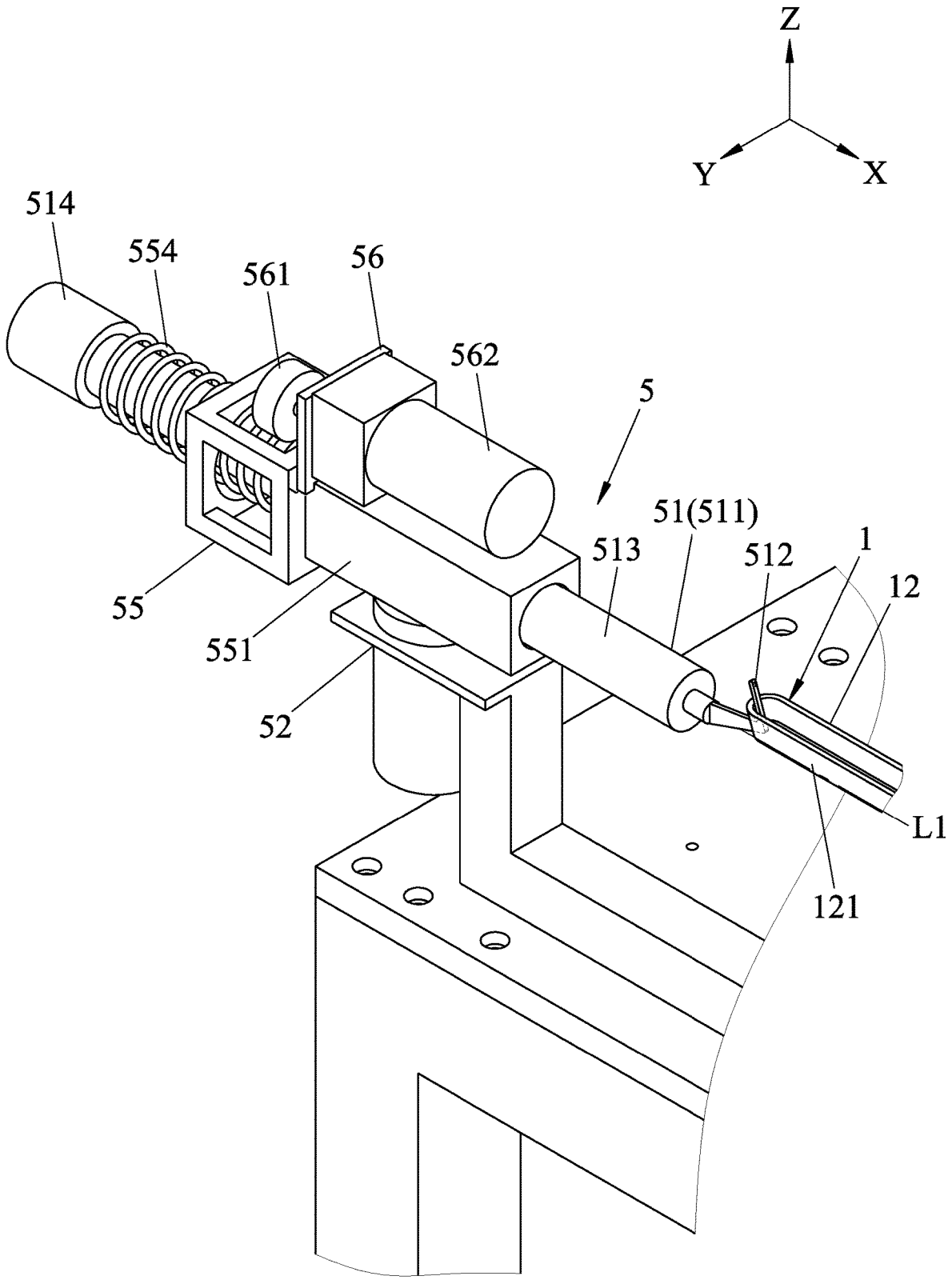

In yet another modification of the embodiment, referring to FIG. 14, the hook 51 has a biasing member 516 which is connected between the tubular member 551 and the larger-diameter segment 514 of the shaft 511 to bias the hook tip 512 away from the shoe upper 2 so as to keep the shoelace 1 in a tensed state.

Figure 15:
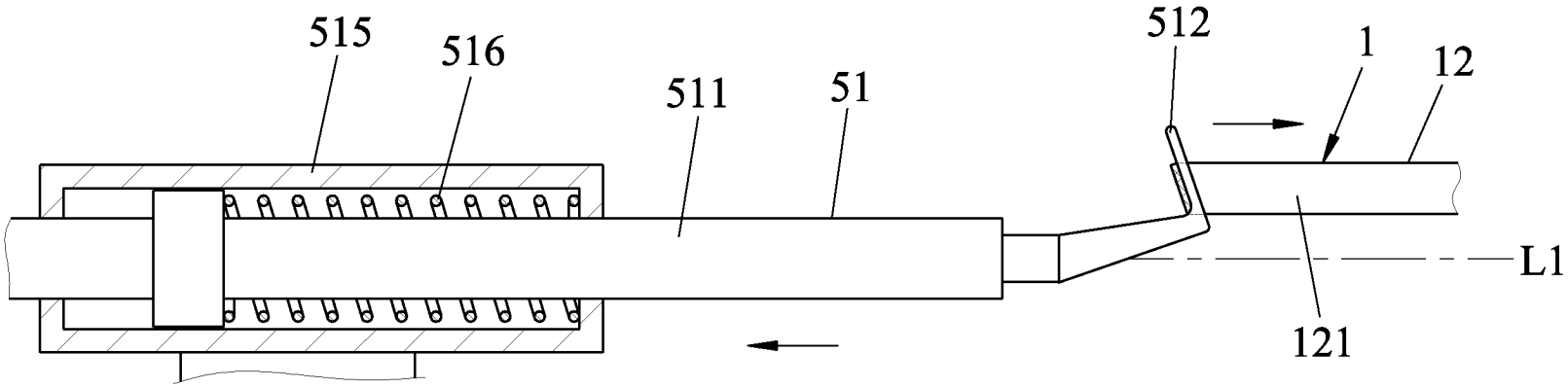
FIG. 15 is a fragmentary sectional view illustrating a hook of the hook unit of the embodiment.

Lastly, in yet another modification of the embodiment, referring to FIG. 15, the hook 51 has a tubular member 515 in which a proximate shaft end of the shaft 511 is movably received, and a biasing member 516 which is connected between the tubular member 515 and a distal shaft end of the shaft 511 to bias the hook tip 512 away from the shoe upper 2 so as to keep the shoelace 1 in a tensed state.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. An automatic shoe-lacing system for securing a shoelace onto a shoe upper, the shoelace having two opposite end portions and a flexible lace body interconnecting the end portions, the shoe upper having a plurality of shoelace eyelets, the flexible lace body having two opposite lace major surfaces, said automatic shoe-lacing system comprising:

a support unit on which the shoe upper is supported;

a robotic arm unit which is disposed to hold at least one of the end portions of the shoelace and to move the at least one end portion along an eyelet passing path, wherein, along the eyelet passing path, the at least one end portion passes through a predetermined number of the shoelace eyelets, and the flexible lace body is extended through and secured on the shoe upper; and at least one hook unit including a hook and a hook driving assembly which is disposed to drive a movement of said hook in a first direction such that, during the movement of the at least one end portion along the eyelet passing path, said hook is disposed to hold the flexible lace body, and is moved relative to the shoe upper between an initial position, where said hook is remote from the shoe upper, and a finished position, where said hook is close to the shoe upper, and such that, during the movement of said hook from the initial position to the finished position, said hook is disposed to tense the flexible lace body, and in the finished position, said hook is disengaged from the shoelace, said hook having a shaft which extends along a shaft axis parallel to the first direction to terminate at a shaft end distal from said hook driving assembly, and a hook tip which is disposed on said shaft end to hook and tense the flexible lace body of the shoelace, said hook unit further including a revolving driving assembly which has a revolving motor that is mounted on said hook driving assembly and that is disposed to drive said shaft to revolve about the shaft axis by a predetermined angle during the movement of said hook from the initial position toward the finished position, so as to bring one of the lace major surfaces of the shoelace into facing the shoe upper.

2. The automatic shoe-lacing system as claimed in claim 1, wherein said hook driving assembly has a slide rail and a rack both of which extend in the first direction and are parallel to each other, a carrier which is slidably disposed on said slide rail and on which said hook is mounted, a first motor which is mounted on said carrier, and a pinion which meshes with said rack and is driven by said first motor such that rotation of said pinion results in the movement of said carrier along said slide rail.

3. The automatic shoe-lacing system as claimed in claim 1, wherein said hook driving assembly has a slide rail which extends in the first direction, a carrier which is slidably disposed on said slide rail and on which said hook is mounted, and a piston-and-cylinder which has a piston rod that is disposed to drive the movement of said carrier along said slide rail.

4. The automatic shoe-lacing system as claimed in claim 1, wherein said hook has a tubular member, said shaft extending in the first direction and having a proximate shaft end which is movably received in said tubular member and a distal shaft end which projects from said tubular member, said hook tip being disposed on said distal shaft end to hook and tense the flexible lace body of the shoelace, said hook further having a biasing member which is connected between said tubular member and said distal shaft end of said shaft to bias said hook tip away from the shoe upper.

5. The automatic shoe-lacing system as claimed in claim 1, wherein said hook unit includes an unhook driving assembly having a rotary worktable which is rotatable about a table axis that is transverse to the shaft axis, and on which said hook driving assembly and said revolving driving assembly are supported, and an unhook motor which is disposed to drive the rotation of said rotary worktable to permit disengagement of said hook tip from the flexible lace body of the shoelace.

6. The automatic shoe-lacing system as claimed in claim 1, wherein said shaft extends along the shaft axis to terminate at proximate and distal shaft ends relative to said hook driving assembly, said hook tip being disposed on said distal shaft end to hook and tense the flexible lace body of the shoelace, said hook driving assembly having a tubular member in which said proximate shaft end of said shaft is movably received, and a biasing member which is connected between said tubular member and said proximate shaft end to bias said hook tip away from the shoe upper.

7. The automatic shoe-lacing system as claimed in claim 1, wherein said shaft extends along the shaft axis to terminate at proximate and distal shaft ends relative to said hook driving assembly, said hook tip being disposed on said distal shaft end to hook and tense the flexible lace body of the shoelace, said hook driving assembly having a tubular member in which said proximate shaft end of said shaft is movably received, a first friction wheel which is rotatable relative to said tubular member and in frictional engagement with said shaft such that rotation of said first friction wheel makes the movement of said shaft in the first direction, and a second motor which is disposed to drive the rotation of said first friction wheel.

8. The automatic shoe-lacing system as claimed in claim 1, wherein said automatic shoe-lacing system comprises two of said hook units which are disposed at two sides of the shoe upper, respectively.

9. An automatic shoe-lacing system for securing a shoelace onto a shoe upper, the shoelace having two opposite end portions and a flexible lace body interconnecting the end portions, the shoe upper having a plurality of shoelace eyelets, the flexible lace body having two opposite lace major surfaces, said automatic shoe-lacing system comprising:

a support unit on which the shoe upper is supported;

a robotic arm unit which is disposed to hold at least one of the end portions of the shoelace and to move the at least one end portion along an eyelet passing path, wherein, along the eyelet passing path, the at least one end portion passes through a predetermined number of the shoelace eyelets, and the flexible lace body is extended through and secured on the shoe upper; and at least one hook unit including a hook and a hook driving assembly which is disposed to drive a movement of said hook in a first direction such that, during the movement of the at least one end portion along the eyelet passing path, said hook is disposed to hold the flexible lace body, and is moved relative to the shoe upper between an initial position, where said hook is remote from the shoe upper, and a finished position, where said hook is close to the shoe upper, and such that, during the movement of said hook from the initial position to the finished position, said hook is disposed to tense the flexible lace body, and in the finished position, said hook is disengaged from the shoelace, said hook having a shaft which extends along a shaft axis parallel to the first direction to terminate at proximate and distal shaft ends relative to said hook driving assembly, and a hook tip which is disposed on said distal shaft end to hook and tense the flexible lace body of the shoelace, said hook driving assembly having a tubular member in which said proximate shaft end of said shaft is movably received, said shaft having a smaller-diameter segment and a larger-diameter segment which are disposed proximate to and distal from said hook tip, respectively, said hook unit including a revolving driving assembly which has a second friction wheel that is rotatable relative to said tubular member and in frictional engagement with said larger-diameter segment of said shaft such that rotation of said second friction wheel makes revolving of said shaft about the shaft axis by a predetermined angle during the movement of said hook from the initial position toward the finished position, so as to bring one of the lace major surfaces of the shoelace into facing the shoe upper, and a revolving motor which is disposed on said tubular member to drive the rotation of said second friction wheel.

10. The automatic shoe-lacing system as claimed in claim 9, wherein said hook unit includes an unhook driving assembly having a rotary worktable which is rotatable about a table axis that is transverse to the shaft axis, and on which said hook driving assembly and said revolving driving assembly are supported, and an unhook motor which is disposed to drive the rotation of said rotary worktable to permit disengagement of said hook tip from the flexible lace body of the shoelace.

11. The automatic shoe-lacing system as claimed in claim 9, wherein said automatic shoe-lacing system comprises two of said hook units which are disposed at two sides of the shoe upper, respectively.

* * * * *